US009004160B2

(12) United States Patent
Greenlee et al.

(10) Patent No.: US 9,004,160 B2
(45) Date of Patent: Apr. 14, 2015

(54) DOWNHOLE TOOL APPARATUS WITH SLIP PLATE AND WEDGE

(71) Applicants: Donald J. Greenlee, Murchison, TX (US); Donald R. Greenlee, Murchison, TX (US)

(72) Inventors: Donald J. Greenlee, Murchison, TX (US); Donald R. Greenlee, Murchison, TX (US)

( * ) Notice: Subject to any disclaimer, the term of this patent is extended or adjusted under 35 U.S.C. 154(b) by 178 days.

(21) Appl. No.: 13/737,068

(22) Filed: Jan. 9, 2013

(65) Prior Publication Data

US 2014/0190682 A1 Jul. 10, 2014

(51) Int. Cl.
*E21B 23/00* (2006.01)
*E21B 33/13* (2006.01)

(52) U.S. Cl.
CPC ..... *E21B 33/13* (2013.01)

(58) Field of Classification Search
CPC ..... E21B 33/12; E21B 33/129; E21B 33/13; E21B 33/134
USPC ..... 166/118, 119, 138, 140
See application file for complete search history.

(56) References Cited

U.S. PATENT DOCUMENTS 5,224,540 A 7/1993 Streich et al.
7,373,973 B2 * 5/2008 Smith et al. ..... 166/134

* cited by examiner

*Primary Examiner* — Yong-Suk (Philip) Ro
(74) *Attorney, Agent, or Firm* — James E. Walton; Brian E. Harris

(57) ABSTRACT

A downhole tool that is used to seal a well bore. The downhole tool has at least one of a nose cap coupled to a slip means for converting shear forces into compression forces, a pultrusion rod, and a butterfly ring. The pultrusion rod extends the full length of the center mandrel. The butterfly ring includes a plurality of wedges configured to remove the extrusion gap when the tool is expanded to prevent failure of a sealing member over increased well bore diameters. The downhole tool includes a pressure equalization port to equalize pressure between a first and a second fluid volume during removal of the tool from the well bore.

16 Claims, 3 Drawing Sheets

DOWNHOLE TOOL APPARATUS WITH SLIP PLATE AND WEDGE

BACKGROUND

1. Field of the Invention

The present application relates generally to downhole tools for use in well bores, as well as methods of using such downhole tools. In particular, the present application relates to downhole tools and methods for plugging a well bore.

2. Description of Related Art

Prior downhole tools are known, such as frac plugs and bridge plugs. Such downhole tools are commonly used for sealing a well bore. These types of downhole tools typically can be lowered into a well bore in an unset position until the downhole tool reaches a desired setting depth. Upon reaching the desired setting depth, the downhole tool is set. Once the downhole tool is set, the downhole tool acts as a plug to seal the tubing or other pipe in the caseing of the well bore.

While lowering, a downhole tool may encounter internal diameter variations within the well bore. Downhole tools are typically sized according to the internal diameter of the well bore. If variations within the well bore are severe enough, the downhole tool with either be prevented from lowering to the correct depth or may fail to fully seal. Additionally, when setting the downhole tool, excessive pressure can result on selected components of the downhole tool resulting in shear forces that exceed tool tolerances. In such applications, components within the downhole tool can shear or break away from the tool resulting in a possible failure to set and fully seal the well bore.

When it is desired to remove many of these types of tools from a well bore, it is frequently simpler and less expensive to mill or drill them out rather than to implement a complex retrieving operation. In milling, a milling cutter is used to grind the plug out of the well bore. Milling can be a relatively slow process. In drilling, a drill bit is used to cut and grind up the components of the downhole tool to remove it from the well bore. This is typically a much faster process as compared to milling.

Drilling out a plug typically requires selected techniques. Ideally, the operator employs variations in rotary speed and bit weight to help break up the metal parts and reestablish bit penetrations should bit penetrations cease while drilling. A phenomenon known as "bit tracking" can occur, wherein the drill bit stays on one path and no longer cuts into the downhole tool. When this happens, it is often necessary to pick up the bit above the drilling surface and rapidly re-contact the bit with the packer or plug and apply weight while continuing rotation. This aids in breaking up the established bit pattern and helps to reestablish bit penetration. However, operators may not recognize when bit tracking is occurring. Furthermore, when operators attempt to rapidly re-contact the drill bit with the downhole tool, the downhole tool may travel with the drill bit as a result of unequalized pressure within the well bore. This is seen typically as drilling has passed through the slip means, thereby decreasing the downhole tool's grip within the well bore. The result is that drilling times are greatly increased because the bit merely wears against the surface of the downhole tool rather than cutting into it to break it up.

Although great strides have been made in downhole tools, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
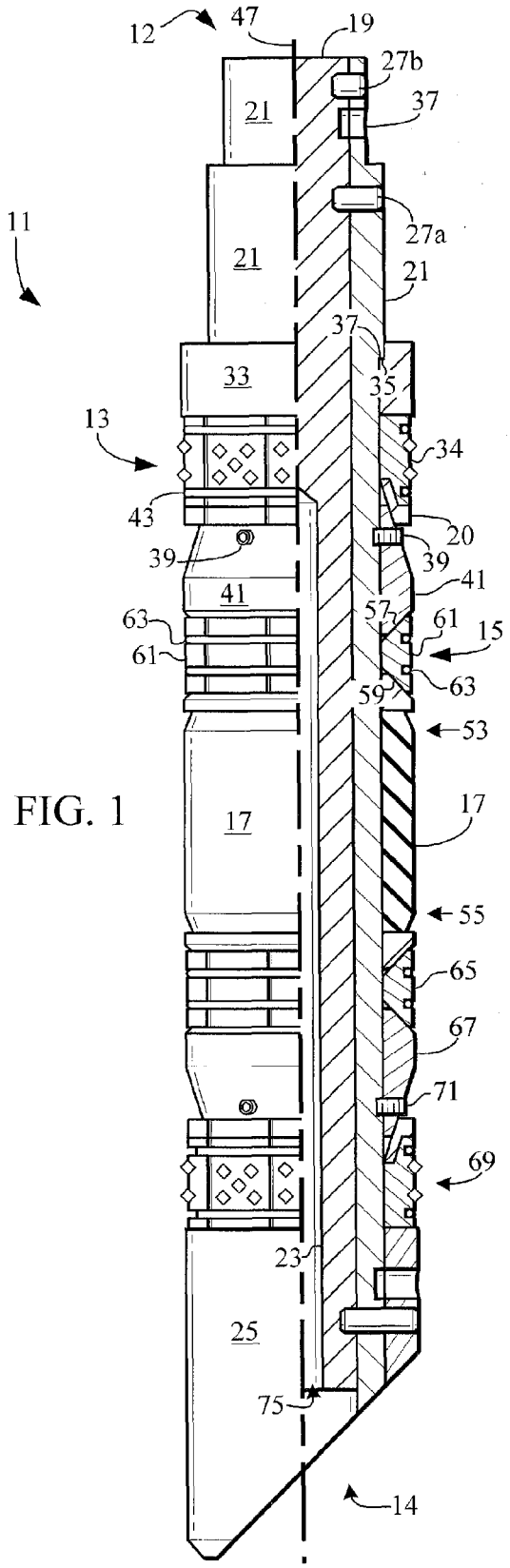
FIG. 1 is a partial section view of a downhole tool according to the present applications.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIG. 1 in the drawings, a partial section view of a downhole tool is illustrated. Downhole tool 11 is an elongated tool configured to pass through a wellhead and into a well bore to a desired location within the well bore. Fluid is permitted to flow around downhole tool 11 during lowering. When downhole tool 11 reaches a desired depth or location, downhole tool 11 is activated in which downhole tool 11 is configured to move a combination of components to allow downhole tool 11 to sealingly engage the interior walls of the well bore. Downhole tool 11 includes at least the following components: a slip means 13, a backup ring 15, and a sealing member 17. Additional components included within downhole tool 11 may be a pultrusion rod 19, a center mandrel 21, and a nose cap 20. Removal of downhole 11 is performed by milling or drilling.

Downhole tool 11 is a tool configured to be lowerable within a well bore and seal or plug the well bore when activated. Downhole tool 11 has an upper end 12 and a lower end 14. When activated, downhole tool 11 seals and engages the well bore and forms two distinct fluid volumes relative to downhole tool 11: an upper fluid volume adjacent upper end 12 and a lower fluid volume adjacent lower end 14. Various types of downhole tools may be used to seal a well bore. Downhole tool 11 may be a packer or a plug. For example, downhole tool 11 may be a bridge plug, frac plug, drillable packer, or retrievable packer. A bridge plug is illustrated in FIG. 1.

Downhole tool 11 comprises center mandrel 21 on which most of the other components are mounted. Mandrel 21 has a central opening 23 there-through the full length of mandrel 21. Pultrusion rod 19 is located within central opening 23 of center mandrel 21. Pultrusion rod 19 can be either pinned or glued within central opening 23. Some embodiments may use both a glue and a pin to secure pultrusion rod 19 in center mandrel 21. A pin 27*a* and 27*b* may be located as shown in FIG. 1 to secure pultrusion rod 19 to mandrel 21. An adhesive, such as glue, provides an additional benefit of sealing the space between pultrusion rod 19 and center mandrel 21 to prevent leakage of fluid between the upper fluid volume and the lower fluid volume. Pultrusion rod 19 is configured to provide internal support to center mandrel 21 as well as muleshoe 25 configured to surround center mandrel 21 adjacent lower end 14. Pultrusion rod 19 may be of varied lengths. Downhole tool 11 uses a full length pultrusion rod 19. An additional benefit of a full length pultrusion rod 19 is the ability to manufacture mandrel 21 directly around pultrusion rod 19. In such a way, a full length pultrusion rod 19 eliminates the additional step of plugging central opening 23 later during manufacturing of downhole tool 11.

Although downhole tool 11 is described as using pins 27*a* and/or 27*b*, it is understood that such pins 27*a*, 27*b* are a redundancy. Such pins 27*a*, 27*b* may be staggard around mandrel 21 in other embodiments. A setting adapter 31 is placed in mandrel 21 to prevent preset of the downhole tool.

A setting ring 33 is located around center mandrel 21 and adjacent slip means 13. Setting ring 33 has a ledge 35 on an internal surface that is formed to match up with and make contact with a shoulder 37 of center mandrel 21. Shoulder 37 is configured to act as a retaining device to prevent setting ring 33 from sliding off of center mandrel 21. A bottom surface of setting ring 33 abuts an upper surface of slip means 13. Slip means 13 has a lower surface that contacts one or more set screws 39. Prior to activation of downhole tool 11, set screw 39 prevents slip means 13 from translating up a cone 41. One or more set screws 39 may be used. In FIG. 1, two set screws 39 are depicted.

Disposed below setting ring 33 is slip means 13, comprising a plurality of slips 34 and cone 41. Slip means 13 is characterized as comprising a plurality of separate non-metallic slips 34 held in place by a retaining member 43, such as retaining band or ring. For example, retaining member 43 may be a composite or metallic band or wire, such as a 19 gauge steel wire. The band extends at least partially around slips 34. Slips 34 may be held in place by other means as well, such as pins. Slips 34 are preferably circumferentially spaced such that a longitudinally extending gap is defined therebetween.

Each slip 34 has an upper surface for contacting setting ring 33, thereby forming an upper end thereof. An upwardly and inwardly facing taper 45 is defined in a lower end of each slip 34. Each taper 45 generally faces the outside of cone 41. In a preferred embodiment, slip means 13 includes nose cap 20. Nose cap 20 is a material, such as aluminum or brass, which is bonded to the lower end and taper 45 of each slip 34. Nose cap 20 is configured to run parallel with taper 45 and contact cone 41 and set screw 39. The thickness of nose cap 20 is dependent of factors such as material strength of the materials used to form nose cap 20.

During activation of downhole tool 11, slip means 13 translates down cone 41 causing each slip to separate in a radial fashion about a central axis 47 of mandrel 21. During activation, each retaining member 43 is configured to break, thereby permitting the separation of slips 34 during activation. A substantial amount of shear forces are present and work on each slip 34 along taper 45 during activation, thereby resulting in a possibility of shearing one or more slips 34. Nose cap 20 is configured to remove shear from slip means 13 and to place slip means 13 in compression when activated. The composite and non-metallic materials used to make downhole tool 11 are stronger in compression than in shear, thereby preventing failure due to shear. Nose cap 20 is configured to convert shear forces into compression forces. Nose cap 20 is capable of withstanding more than double the amount of shear forces before failure. Nose cap 20 is bonded to each slip 34. Bonding may be done by an adhesive.

Figure 2:
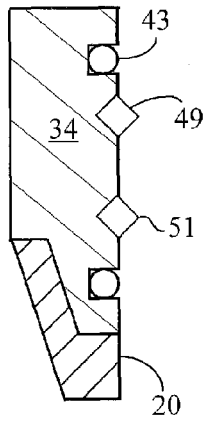
FIG. 2 is side view of a slip within a slip means used with the downhole tool of FIG. 1, the slip having a nose cap.

A plurality of inserts or teeth 49 preferably are molded into slips 34. Inserts 49 may have a generally cylindrical configuration and are positioned at an angle with respect to the central axis 47. Thus, a radially outer edge 51 of each insert 49 protrudes from the corresponding slip 34. Outer edge 51 is adapted for grippingly engaging well bore when downhole tool 11 is set or activated. It is not intended that inserts 49 be limited to this cylindrical shape or that they have a distinct outer edge. Various shapes of inserts 49 may be used. FIGS. 1 and 2 illustrate a square shaped insert 49. Inserts 49 can be made of any suitable hard material. For example, inserts 49 could be hardened steel or a non-metallic hardened material, such as ceramic.

Slip means 13 further comprises cone 41. Cone 41 is disposed adjacent to slips 34 and engages taper 45 therein. Set screws 39 are sheared upon activation or setting of the downhole tool 11 which permits movement of the associated components to engage and seal the well bore.

Upon activation of downhole tool 11, an upper end 53 and a lower end 55 of sealing member 17 and compressed toward one another thereby causing sealing member 17 to bulge outward and contact the well bore. When fully activated, sealing member 17 forms a fluid type seal radially around the internal surface of the well bore. In doing so, upper fluid volume and a lower fluid volume is formed in relation to which end of downhole tool lithe fluid volume is adjacent to.

Pressure increases in below sealing member 17 within lower fluid volume. A pressure differential therein is created between the upper fluid volume and the lower fluid volume. Pressure pushes against downhole tool 11 from lower fluid volume. Inserts 49 are configured to grip the walls of well bore to prevent movement of downhole tool 11 from this pressure differential. The pressure differential operates on sealing member 17, causing sealing member 17 to flex and distort. If such distortion or flexing becomes large enough, sealing member 17 can fail. Backup ring 15 is used in a similar function as described with slip means 34. Backup ring 15 surrounds mandrel 21. Backup ring 15 has an upper taper 57 for contacting a parallel surface of cone 41 below slip means 13. A lower taper 59 also contacts an opposing parallel surface. Like unto slip means 13, Backup ring 15 includes a plurality of single wedges 61 bound together radially around axis 47 of mandrel 21.

Backup ring 15 is characterized as comprising a plurality of separate non-metallic wedges 61 held in place by a retaining member 63, such as a retaining band or ring. For example, retaining member 63 may be a composite or metallic band or wire, such as a 19 gauge steel wire. The band extends at least partially around wedges 61. Wedges 61 are preferably circumferentially spaced such that a longitudinally extending gap is defined therebetween. During activation, each retaining member 63 is configured to break, thereby permitting the separation of wedges 61 in an outward direction so as to contact the wall of the well bore. The gap between such wedges 61 when activated is referred to as an extrusion gap. Backup ring 15 is configured to act as a support to sealing member 17 to prevent the flexing and distortion. Sealing member 17 is configured to flex and contact backup ring 15 in response to the differential pressure.

Below sealing member 17, adjacent lower end 14 of downhole tool 11, are similar components to that described previously. Namely, a backup ring 65, a cone 67, a slip means 69, and set screws 71 are similar in form and function to that of those described under the same or similar name with respect to upper end 12 of downhole tool 11. Additionally, the lower end 14 includes a muleshoe 25 configured to contact a lower portion of slip means 69 in place of a secondary setting ring. Pultrusion rod 19 is configured to extend the full length of mandrel 21 from upper end 12 to lower end 14, so as to provide increased strength sufficient to prevent the splintering of mandrel 21 or muleshoe 25 due to increased pressures in lower fluid volume.

Additionally, downhole tool 11 is configured to include a pressure equalization port configured to permit the equalization of pressure between the upper fluid volume and the lower fluid volume during removal of downhole tool 11. The equalization port is configured to automatically equalize the pressure during removal. Downhole tool 11 is configured to be drilled or milled out from the well bore. In such instances, a bit configured to remove the tool 11 is lowered into the well bore and begins to chip away or break away small portions of tool 11, beginning at upper end 12. As slip means 13 is removed, inserts 49 are removed and tool 11 becomes susceptible to axial movement within the well bore. Where the pressure differential is large enough, slip means 69 may be insufficient to stabilize tool 11 during removal. The equalization port of tool 11 is configured to be in open communication with the lower fluid volume and extend through one or more components of tool 11 to a distance at least equal with slip means 13. As seen in FIG. 1, pressure equalization port 75 is located within pultrusion rod 19. During removal, when the bit has reached slip means 13, sufficient quantities of tool 11 will be removed so as to expose pressure equalization port 75 to upper fluid volume prior to removal of all inserts 49. Equalization port 75 is configured to achieve open communication with both upper fluid volume and the lower fluid volume. Equalization port 75 is configured to decrease the pressure differential between the two fluid volumes so as to prevent axial movement and bit tracking during tool removal.

Although equalization port 75 is described as being located entirely within pultrusion rod 19, it is understood that equalization port 75 is not so limited and may be located in one or more other components of tool 11 as long as pressure is permitted to equalize between the two fluid volumes. Therefore, equalization port 75 may be used in any length of pultrusion rod 19.

As seen in FIG. 1, downhole tool 11 is configured to use nose cap 20 to eliminate shear on slips 34. Downhole tool 11 is also configured to include pultrusion rod 19, wherein pultrusion rod 19 extends the full length of mandrel 21. It is understood that alternative embodiments of downhole tool 11 may use a pultrusion rod having any length and is not limited to the length illustrated or described previously. Additionally, alternative embodiments may utilize a full length pultrusion rod 19 and not include nose cap 20. In such instances, each slip 34 would be sized to include the area currently used with nose cap 20. Also, equalization port is optionally used with nose cap 20 and pultrusion rod 19.

Figure 3:
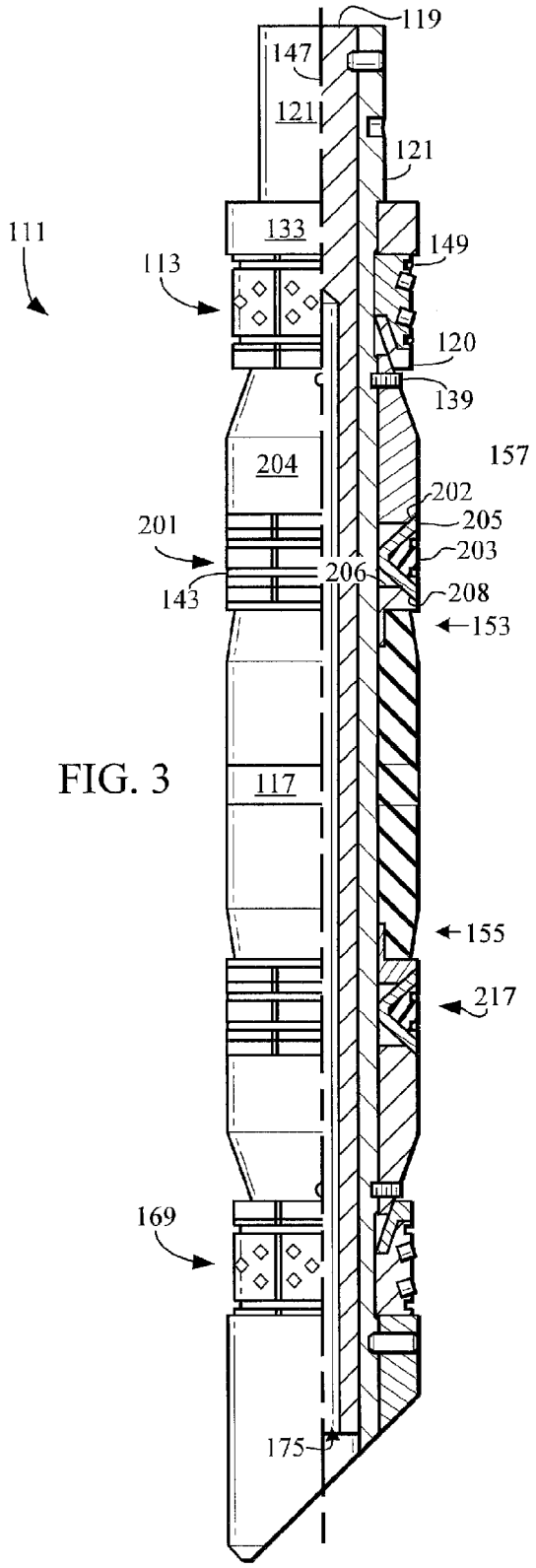
FIG. 3 is a partial section view of an alternate embodiment of the downhole tool of FIG. 1, the tool using a butterfly ring.
Figure 4:
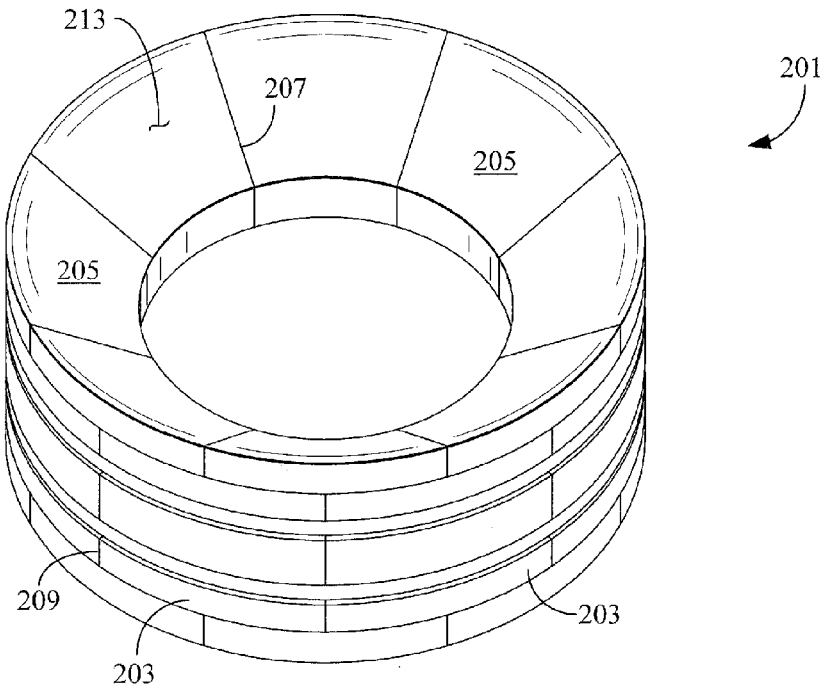
FIG. 4 is a perspective view of the butterfly ring of FIG. 3 in a first orientation.
Figure 5:
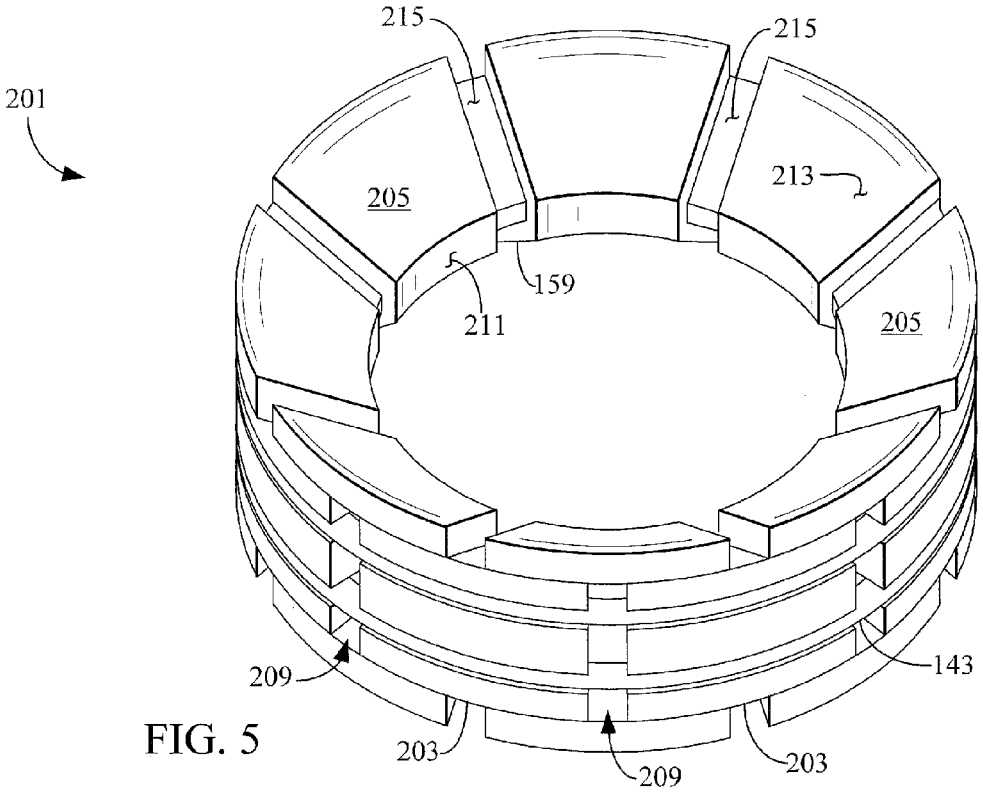
FIG. 5 is a perspective view of the butterfly ring of FIG. 3 in a second orientation.

Referring now also to FIGS. 3-5 in the drawings, a second embodiment of the present application is illustrated. Downhole tool 111 is illustrated in FIG. 4. Downhole tool 111 is an extended range tool similar in form and function to that of downhole tool 11 in FIG. 1. Downhole tool 111 includes the similar components having the same or similar functions as described with respect to FIG. 1. The numerical identifier of same or similar components from FIG. 1 are used with respect to FIG. 4 except that the numerical identifier will include a "1" in the hundreds place holder. For example, 11 in FIG. 1 will be 111 in FIG. 4 and so forth. The differences between downhole tool 11 and 111 are noted herein.

Pre-set or pre-activated downhole tools can be sized to have different external diameters. In use, the external diameter is sized to work with selected sized internal diameter well bores. Sealing members may also vary in length to compensate for the size difference between the pre-set external diameter of a downhole tool and the internal diameter of the well bore. However, as the pre-set size difference between the external diameter of the tool and the internal diameter of the well bore increases, the farther the slip means and backup rings have to expand to contact the well bore. This results in greater gaps (extrusion gap) between individual slips and wedges. Where the extrusion gap is sufficiently large, the pressure differential between fluid volumes can flex and/or distort the sealing member through the extrusion gap so as to cause failure of the downhole tool to seal the well bore. Furthermore, well bores do not always maintain a consistent internal diameter, thereby having a max internal diameter and a minimum internal diameter. The downhole tool is sized to fit through the smallest internal diameter but then may be incapable of sealing the well bore at a location measuring the maximum internal diameter.

Downhole tool 111 may be termed an extended range tool, being similar in form and function to that of tool 11 in FIG. 1. Downhole tool 111 is configured to provide an increasing wedge surface area so as to provide increasing surface area to support the sealing member and to prevent extrusion or failure of the sealing member while sealed. For example, the surface area used to contact portions of the sealing member increase over what was exposed prior to activation of tool 111.

Downhole tool 111 includes a butterfly ring 201 in place of backup ring 65 used in tool 11. Butterfly ring 201 is configured to eliminate and/or minimize an extrusion gap formed during expansion when the sealing member is activated.

Upon activation of downhole tool 111, an upper end 153 and a lower end 155 of sealing member 117 and compressed toward one another thereby causing sealing member 117 to bulge outward and contact the well bore. When fully activated, sealing member 117 forms a fluid type seal radially around the internal surface of the well bore. In doing so, an upper fluid volume and a lower fluid volume is formed in relation to which end of downhole tool 111 the fluid volume is adjacent to.

Pressure increases below sealing member 117 within lower fluid volume when tool 111 is sealed to the well bore. A pressure differential therein is created between the upper fluid volume and the lower fluid volume. Pressure pushes against downhole tool 111 from lower fluid volume. Inserts 149 are configured to grip the walls of well bore to prevent movement of downhole tool 111 resulting from this pressure differential. The pressure differential operates on sealing member 117, causing sealing member 117 to flex and distort. If such distortion or flexing becomes large enough, sealing member 117 can fail.

Butterfly ring 201 has an upper taper 157 for contacting a parallel surface 202 of cone 204 (similar in form and function to cone 41) located below slip means 113. A lower taper 159 of butterfly ring 201 also contacts an opposing parallel surface 208 on a slide ring 206. Taper 204 is parallel to butterfly ring 201 and is configured to permit sliding translation between butterfly ring 201 and taper 204. Slide ring 206 also has a tapered surface 208 that is parallel to a surface of butterfly ring 201 and is configured to permit sliding translation between butterfly ring 201 and taper 208. Sliding ring 206 is also configured to contact sealing member 117.

Butterfly ring 201 is characterized as comprising a plurality of separate internal wedges 203 and a plurality of separate outer wedges 205. Wedges 203 and 205 are radially spaced around central axis 147 and are held in place by a retaining member 143 similar in form and function to that of retaining member 43. Wedge 205 has an internal surface 211 to rest against mandrel 121 while in a pre-set condition. Internal wedge 203 is configured to translate within a portion of wedge 205.

Wedges 203 and 205 are preferably circumferentially spaced such that a longitudinally extending gap 207, 209 is defined therebetween. The longitudinal gaps 207 between wedges 205 are offset from the longitudinal gap 209 of wedges 203. Prior to activation of tool 111, butterfly ring 201 is configured to rest around mandrel 121 in a first orientation as seen in FIG. 4. When tool 121 is activated, butterfly tool 201 expands to a second orientation, as seen in FIG. 5. As can be seen in FIG. 5, when in the second orientation, gaps 207 and 209 remain offset.

Wedge 205 has a wedge surface 213 adjacent sealing member 117. Wedge 203 has an wedge surface 215. In the first orientation, gap 209 is closed and surface 215 is hidden or concealed by wedge 205. In the second orientation, gap 209 is opened, thereby exposing surface 215. Surfaces 213 and 215 are herein termed a wedge surface. As butterfly ring 201 transforms from the first orientation to the second orientation, the total surface area exposed to sealing member 117 increases due to gap 209 exposing surface 215. In so doing, butterfly ring 201 is configured to eliminate or remove the extrusion gap, gap 209, during expansion when activated. Additionally, butterfly ring 201 is configured to prevent failure of sealing member 117 due to extrusion and failure of sealing member 117. Furthermore, wedge 203 is configured to bridge gap 209. The ability of butterfly ring 201 to provide a variable or increased surface area permits a single sized tool 111 to sufficiently support sealing member 117 from failure due to pressure differentials between the two fluid volumes over a wider range of internal diameters of the well bore. Tool 111, incorporating butterfly ring 201, is therefore more versatile.

It is understood that butterfly ring 201 may be used individually with other components of a downhole tool or may be incorporated with any combination of pultrusion rod 19 and nose cap 20 described previously. Furthermore, tool 111 includes a second butterfly ring 217 opposite sealing member 117 from butterfly ring 201. Butterfly ring 217 is similar in form and function to that of butterfly ring 201.

The current application has many advantages over the prior art including the following: (1) a full length pultrusion rod; (2) an equalization port to permit automatic pressure equalization during tool removal; (3) a nose cap to remove shear forces by converting them into compression forces; (4) the ability to operate with well bores having internal diameters which vary in size; and (5) a butterfly ring configured to bridge the gap between outer wedges and eliminate the extrusion gap.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A downhole tool for use in a well bore, comprising
- a center mandrel;
- a slip means configured to grippingly engage the well bore, the slip means being slidingly disposed around the center mandrel;
- a nose cap in communication with the slip means, the nose cap being configured to remove shear force from the slip means and to place the slip means in compression; and
- a butterfly ring configured to eliminate an extrusion gap formed during expansion of the sealing member, the butterfly ring comprising:
  - a plurality of inner wedges separated by inner wedge gaps; and
  - a plurality of outer wedges separated by outer wedge gaps,
  - wherein the inner wedge gaps are offset from the outer wedge gaps such that the inner wedges bridge respective outer wedge gaps,
- wherein the downhole tool is a configured to sealingly engage the well bore to divide fluid within the well bore into at least two distinct fluid volumes, an upper fluid volume and a lower fluid volume.

2. The downhole tool of claim 1, wherein the nose cap is at least one of aluminum and brass.

3. The downhole tool of claim 1, wherein the nose cap is bonded to the slip means.

4. The downhole tool of claim 1, further comprising:
- a pressure equalization port configured to automatically equalize pressure between the upper fluid volume and the lower fluid volume during removal of the downhole tool from the well bore.

5. The downhole tool of claim 4, wherein the pressure equalization port is located within a pultrusion rod.

6. The downhole tool of claim 5, wherein the pultrusion rod extends the length of the mandrel and is configured to provide internal support to a muleshoe.

7. A downhole tool for use in a well bore, comprising:
- a center mandrel;
- a slip means configured to grippingly engage the well bore, so as to prevent movement of the downhole tool within the well bore;

a sealing member configured to sealingly engage the well bore to divide fluid within the well bore into at least two distinct fluid volumes, an upper fluid volume and a lower fluid volume;

a pressure equalization port configured to automatically equalize pressure between the upper fluid volume and the lower fluid volume during removal of the downhole tool from the well bore; and a butterfly ring configured to eliminate an extrusion gap formed during expansion of the sealing member, the butterfly ring comprising:

a plurality of inner wedges separated by inner wedge gaps; and a plurality of outer wedges separated by outer wedge gaps, wherein the inner wedge gaps are offset from the outer wedge gaps such that the inner wedges bridge respective outer wedge gaps.

8. The downhole tool of claim 7, wherein the pressure equalization port is located within a pultrusion rod, the pultrusion rod being located within the center mandrel.

9. The downhole tool of claim 8, wherein the pultrusion rod extends the length of the center mandrel.

10. The downhole tool of claim 7, further comprising:

a pultrusion rod extending the full length of the center mandrel, the pultrusion rod being located internally within the center mandrel.

11. The downhole tool of claim 10, wherein the pultrusion rod is configured to prevent the center mandrel from splintering under pressure.

12. A downhole tool for use in a well bore, comprising:

a slip means configured to grippingly engage the well bore, so as to prevent movement of the downhole tool within the well bore;

a sealing member configured to expand and sealingly engage the well bore, so as to divide fluid within the well bore into at least two distinct fluid volumes, an upper fluid volume and a lower fluid volume; and a butterfly ring configured to eliminate an extrusion gap formed during expansion of the sealing member, the butterfly ring comprising:

a plurality of inner wedges separated by inner wedge gaps; and a plurality of outer wedges separated by outer wedge gaps, wherein the inner wedge gaps are offset from the outer wedge gaps such that the inner wedges bridge respective outer wedge gaps.

13. The downhole tool of claim 12, wherein the butterfly ring is configured to prevent extrusion and failure of the sealing member.

14. The downhole tool of claim 12, further comprising:

a nose cap in communication with the slip means, the nose cap being configured to remove shear force from the slip means and to place the slip means in compression.

15. The downhole tool of claim 14, wherein the nose cap is adhesively bonded to the slip means.

16. The downhole tool of claim 14, wherein the slip means are held together in a pre-set state with a metallic wire configured to break upon activation.

* * * * *